United States Patent [19]

Deal

[11] Patent Number: 4,991,837

[45] Date of Patent: Feb. 12, 1991

[54] BASKETBALL HOOP VISUAL GUIDE

[76] Inventor: Richard E. Deal, 614 S. Moore, Algona, Iowa 50511

[21] Appl. No.: 409,246

[22] Filed: Sep. 19, 1989

[51] Int. Cl.[5] ..... A63B 63/08

[52] U.S. Cl. ..... 273/1.5 R

[58] Field of Search ..... 273/1.5 R A

[56] References Cited

U.S. PATENT DOCUMENTS

| | | | |
|---|---|---|---|
| 1,520,196 | 12/1924 | Medart et al. | 273/1.5 R |
| 1,544,453 | 6/1925 | Harbison | 273/1.5 R |
| 2,579,312 | 12/1951 | Garvey | 273/1.5 R |
| 3,109,647 | 11/1963 | Austin | 273/1.5 R |
| 3,814,421 | 6/1974 | Spier, Jr. | 273/1.5 A |
| 4,082,269 | 4/1978 | Hill | 273/1.5 R |
| 4,353,548 | 10/1982 | Mahoney | 273/1.5 R |
| 4,805,903 | 2/1989 | McArdle | 273/1.5 R |
| 4,834,368 | 5/1989 | Qualley | 273/1.5 R |
| 4,836,539 | 6/1989 | Knapp | 273/1.5 A |

*Primary Examiner*—Paul E. Shapiro

*Attorney, Agent, or Firm*—Zarley, McKee, Thomte, Voorhees & Sease

[57] ABSTRACT

A visual guide for improving accuracy of shooting a basketball into a basketball hoop is shown which consists of an annular member which extends below the rim of the basketball hoop. The annular member provides a visual guide as to the location of the rim and the opening for shooting the basketball. The annular member may be mounted by any one of a variety of devices onto the hoop so that the annular member extends below the rim. Such mounting devices may include, for example, a plurality of holes throughout the annular member and a rope looped through those holes and the net holding device, a tab with a snap looped over the net holding device, a hook extending upwardly from the annular member to be engaged with the rim of the basketball hoop, or a series of loops attached to the interior of the annular member with a mounting rope threaded through the net holding device and through the loop.

18 Claims, 4 Drawing Sheets

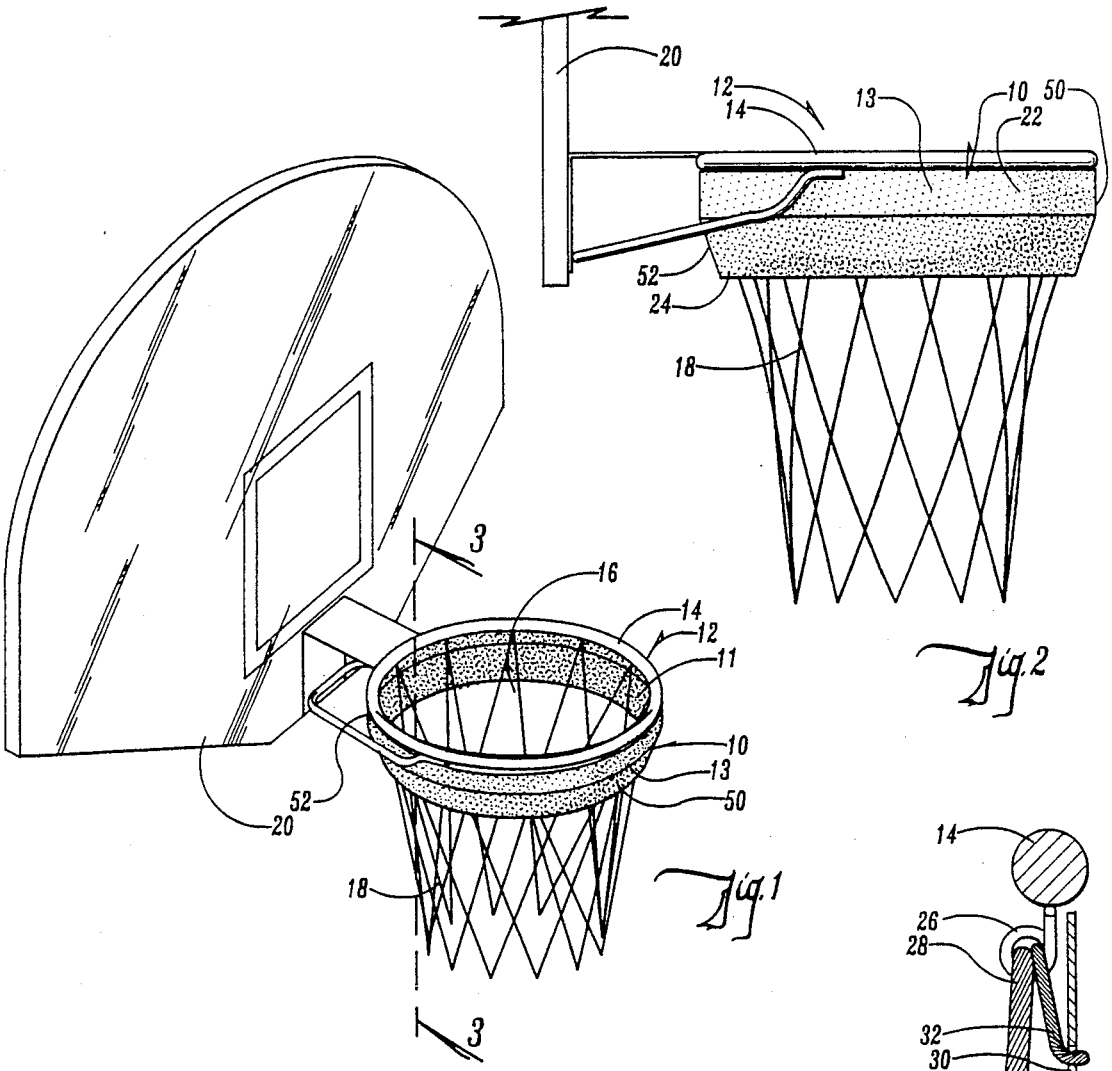
Fig. 2
Fig. 1
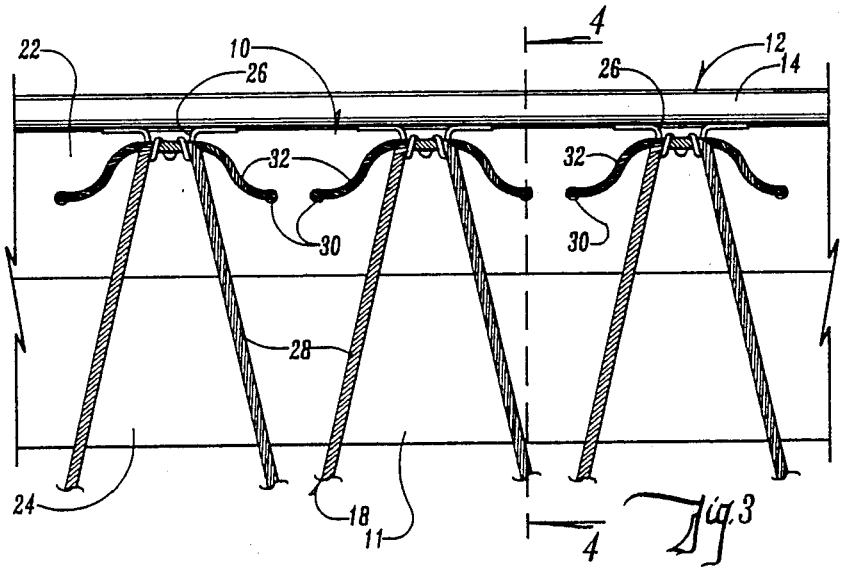
Fig. 3
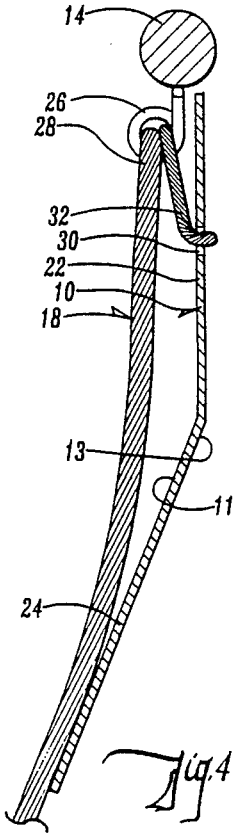
Fig. 4

BASKETBALL HOOP VISUAL GUIDE

BACKGROUND OF THE INVENTION

A conventional basketball hoop which is mounted with a backboard in an elevated position on a pole consists of a rim attached to the backboard and netting which extends downwardly and inwardly from the rim. The rim is narrow and horizontally positioned. When shooting basketballs, it is somewhat difficult to coordinate view of the thin, raised rim and movement of the arms and hands to propel the basketball into the opening in the rim. This invention relates to a device designed to aid in improving shooting accuracy by providing an enhanced visual guide as to the location and orientation of the rim and the opening. It provides a target area for which the player may shoot in order to improve shooting accuracy.

Therefore, it is a primary object of this invention to provide for a device which provides a visual guide for shooting basketballs into a basketball hoop.

A further object of the invention is to provide for a visual guide in improving accuracy of shooting basketballs into a basketball hoop.

Another object of the invention is to provide for a visual guide for improving shooting accuracy of basketballs into a basketball hoop which is distinctive and easy to see.

Yet another object of the invention is to provide for a device for improving accuracy of shooting basketballs into a basketball hoop which is easily mounted onto the basketball hoop.

Still further objects of the invention will become apparent in the following disclosure.

SUMMARY OF THE INVENTION

The invention relates to a visual guide which consists of an annular member capable of being mounted below the rim of the basketball hoop and extending downwardly from the rim outside the netting. The device enhances visual identification of the rim and opening in the rim. The device may be mounted on the basketball hoop by any one of a variety of means or methods. These include providing holes within the annular member for threading a rope, providing a snap on the annular member to loop over the rim of the hoop, providing a hook extending upward from the annular member to hook onto the rim, and providing a loop fastened to the inside of the annular member for threading a rope.

DESCRIPTION OF THE DRAWINGS

FIG. 1 is a perspective view of an embodiment of the device of this invention mounted onto a basketball hoop.

FIG. 2 is a side elevational view of the device of this invention mounted onto a basketball hoop.

FIG. 3 is a sectional view taken along line 3—3 of FIG. 1 of the interior of the basketball hoop showing a mounting means of the device of this invention.

FIG. 4 is a sectional view taken along line 4—4 of FIG. 3.

DETAILED DESCRIPTION OF THE INVENTION

Figure 5:
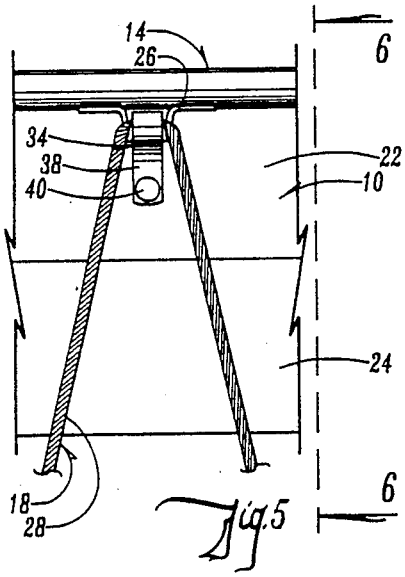
FIG. 5 is a partial interior view of the device of this invention showing a second embodiment of the mounting means

The visual guide device, according to the present invention, is an annular member represented as 10. It is shown in FIGS. 1 and 2 mounted on a basketball hoop 12. Annular member 10 has an interior surface 11 and exterior surface 13. The basketball hoop 12 consists of a rim 14 which provides an opening 16 for shooting basketballs into. Descending downwardly from the rim 14 and sloping inward is netting 18. The hoop 12 is attached by any one of a variety of means to a backboard 20, which is then typically mounted on a vertical pole (not shown) to elevate hoop 12 and backboard 20 (typically to approximately 10 feet above the ground or floor).

The annular member 10 provides a visual guide by extending downwardly from the bottom of rim 14. The exact length that the annular member 10 extends downward from the rim 14 is not critical, as long as it forms a sufficient visual guide as to the location of the rim 14 and consequently the opening 16. The circumference of annular member 10 is such that it is greater than the maximum circumference of netting 18 so that the annular member 10 may surround the upper portion of netting 18. As can also be seen in FIGS. 4 through 10, for all embodiments shown, the annular member 10 is of thin cross-section. For ornamental purposes, it is possible to provide that the annular member 10 descends from the rim 14, and then slopes inwardly toward netting 18. This provides for an attractive configuration in combination with basketball hoop 12. Member 10 is shown more particularly in FIG. 2 as including an upper portion 22 which extends downward from the rim 14 and a lower portion 24 which then slopes inwardly. It is clear that a number of variations upon the exact configuration and shape of the annular member 10 are possible so that it provides a visual guide. The annular member 10 may be made of any of a variety of materials suitable for purposes of use in basketball and for the environment in which basketball hoops are placed, both indoors and outdoors, and, for example, may be made of rigid material, such as stiff plastic to provide for an inexpensive and durable annular member 10. It also may be made of rubber or rubberlike material, for example, such as polyvinylchloride.

Annular member 10 is mounted to the basketball hoop 12 by any one of a variety of different means, so that the annular member 10 extends downward from rim 14 and outside of netting 18.

Several different embodiments are shown in the drawings for mounting the annular member 10 onto the basketball hoop 12.

FIGS. 3 and 4 demonstrate one embodiment of the mounting means. In FIG. 3, it can be seen that the netting 18 is held in place on the basketball hoop 12 by a plurality of net holding means here shown as eyelets 26. These eyelets 26 are attached to the underside of rim 14 at spaced apart positions around the rim. Each eyelet 26 loops back onto itself so that the netting rope 28 may be slipped into eyelet 26 and held in place thereby. In this embodiment, a plurality of holes 30 are provided throughout the annular member 10. A mounting rope 32, which may be similar to the netting rope 28, is then looped throuqh these holes 30 and the mounting rope 32 is guided through the eyelet 26. This would allow an existing device, the eyelet 26, to be used for mounting annular member 10 below rim 14.

Figure 6:
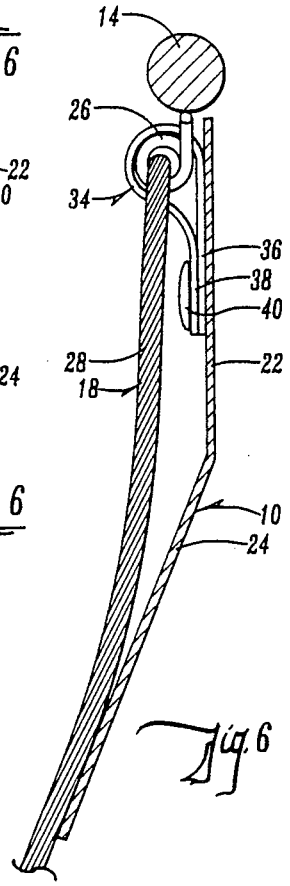
FIG. 6 is a sectional view taken along line 6—6 of FIG. 5.

FIGS. 5 and 6 demonstrate a second embodiment of a mounting means of the invention. A flexible elongated tab 34 is shown having a first end 36 and a second end 38. First end 36 is fixedly mounted to the interior side 11 of annular member 10. Second end 38 of tab 34 has thereon a snap 40. It is capable of engaging a mating member on the interior surface of first end 36 (not shown). In this manner, the tabs 34, at spaced apart locations around member 10 coincident with means 26 around rim 14 may be looped over eyelet 26 and snaps 40 engaged in order to hold the annular member 10 below rim 14.

Figure 7:
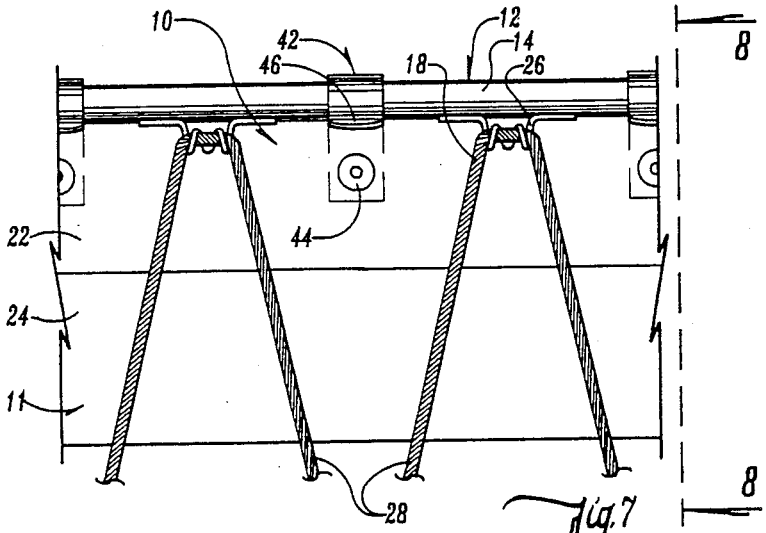
FIG. 7 is a partial interior view of the device of this invention showing a third embodiment of a mounting means of the device of this invention.
Figure 8:
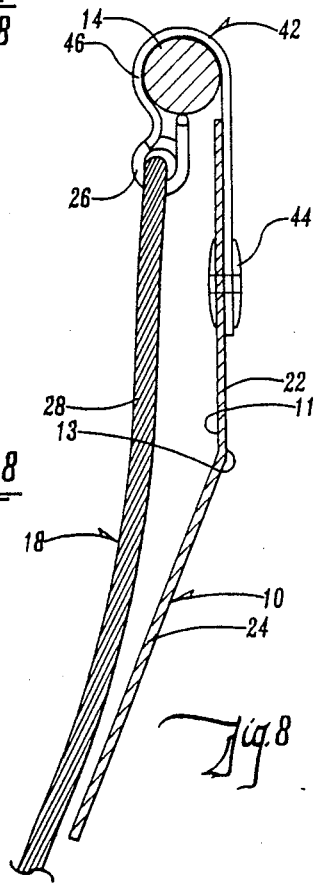
FIG. 8 is a sectional view taken along line 8—8 of FIG. 7.

A third embodiment of the mounting means is shown in FIGS. 7 and 8. A plurality of hooks 42 are fixedly mounted at spaced apart locations around annular member 10. Hooks 42 may be mounted to either the exterior 12 or interior 11 of annular member 10. In the embodiment shown, hooks 42 are mounted by means of rivets 44 to the exterior side 12 of annular member 10. The hooks 42 are attached such that the arch portion 46 faces the interior side 11 of annular member 10. Hooks 42 are then attached to the rim 14 by mounting arched portion 46 on top of rim 14. This then allows the annular member 10 to extend below rim 14. It also allows annular member 10 to be mounted to rim 14 independent of eyelets 26. The hooks 42 can be hooked onto rim 14 at locations intermediate of eyelets 26.

Figure 9:
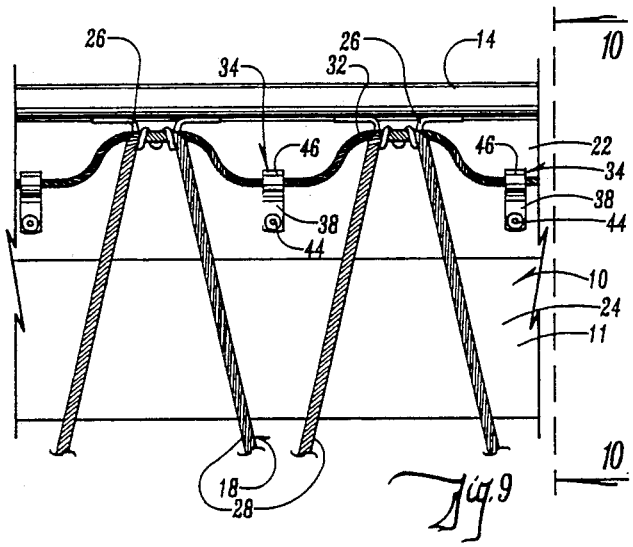
FIG. 9 is a partial interior view showing a fourth embodiment of a mounting means of the device of this invention.
Figure 10:
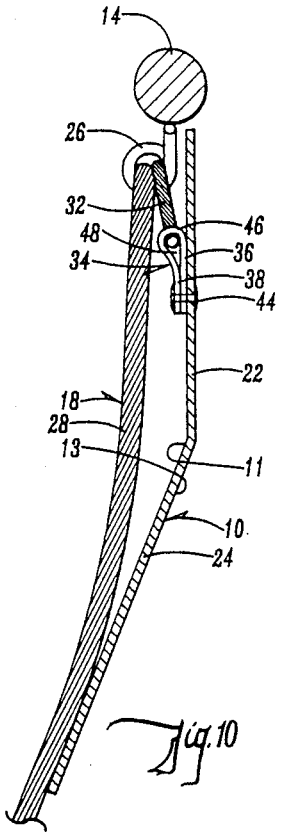
FIG. 10 is a sectional view taken along line 10—10 of FIG. 9.

Yet another embodiment of a mounting means is shown in FIGS. 9 and 10. This also employs a plurality of tabs 34 forming loops attached at spaced apart positions to the interior side 11 of annular member 10. However, instead of being provided with snaps, both first end 36 and second end 38 of tabs 34 are rigidly attached to the interior of annular member 10 by means of a rivet 44 to form a loop. A mounting rope 32 is then threaded through the plurality of eyelets 26 and openings 48 provided by tabs 34. By placing the tabs 34 on the interior surface 11, the appearance of the annular member 10 while on the hoop 12 is enhanced.

Still another mounting means could include mounting Velcro® strips to the annular member to pass over rim 114 or eyelets 26.

Figure 11:
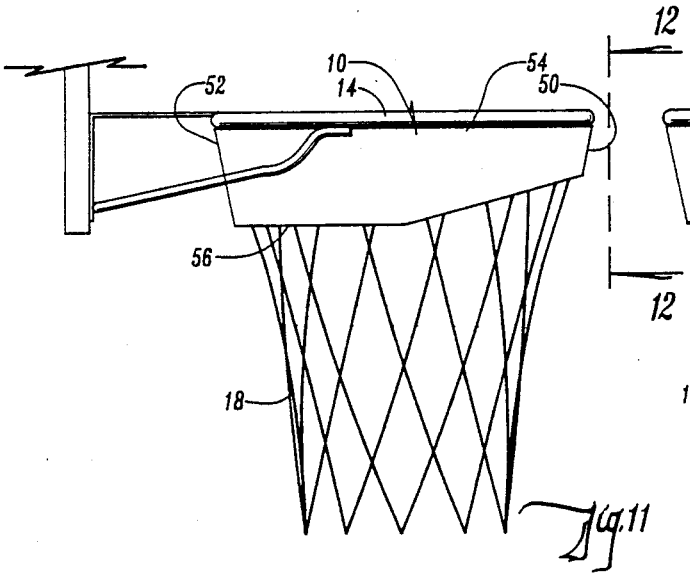
FIG. 11 is a side elevational view of another embodiment of the visual guide of this invention.
Figure 12:
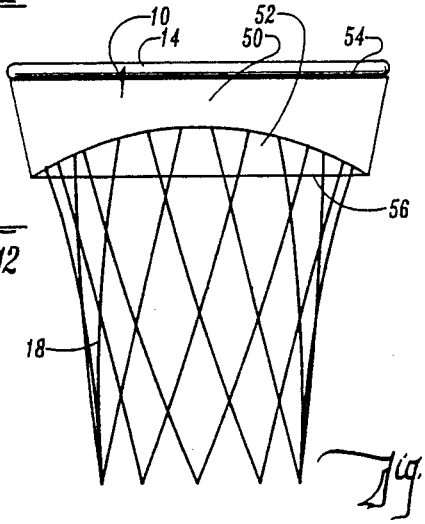
FIG. 12 is a front elevational view of an embodiment of the visual guide of this invention along line 12—12 of FIG. 11.
Figure 13:
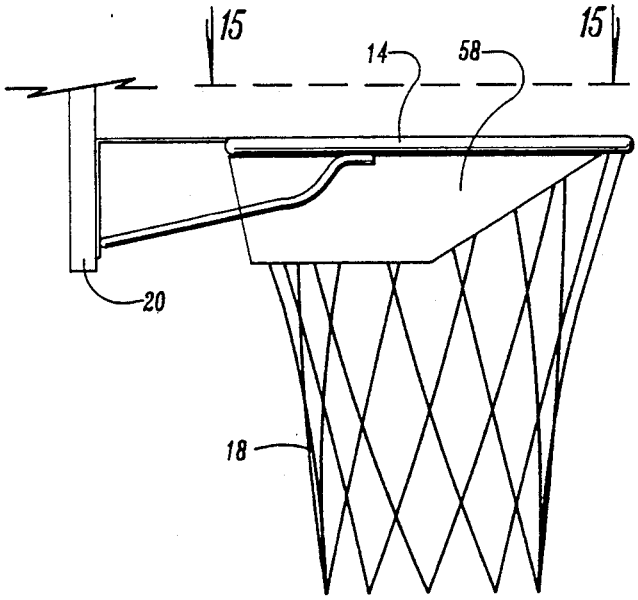
FIG. 13 is a side elevational view of another embodiment of the visual guide of this invention.
Figure 14:
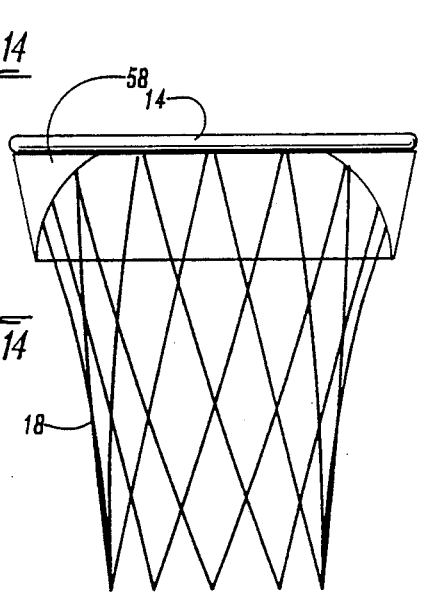
FIG. 14 is a front elevational view taken along line 14—14 of FIG. 13.
Figure 15:
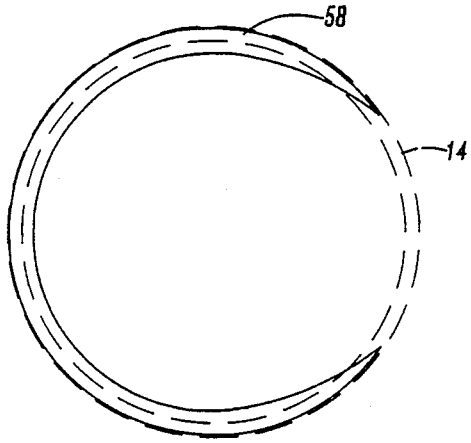
FIG. 15 is a top sectional view taken along line 15—15 of FIG. 13.

To further enhance the visual impact of the annular member 10, the interior surface 11 may be a different color than exterior surface 12 of the member 10. The contrast may be enhanced in other ways, as by contrasting surfaces interior and exterior, or varying thickness of annular member 10 with the forward half 50 shorter than rearward half 52. This embodiment may be seen in FIGS. 11 and 12. Here it can be seen that the forward portion 50 is thinner from the top 54 of annular member 10 to the bottom 56 of the annular member, than is the rearward portion 52. Yet another embodiment is shown in FIGS. 13 through 15. Here, a member 58 is shown which forms a partial circle. This is best seen in FIG. 15. Of course, this member may be an annular member 10 which has been cut, or may be a preformed partially circular member. It also may be shorter in the front portion as compared to the rearward portion, as shown.

Variations and modifications upon the invention, including the means of mounting the annular member to the basketball hoop may be used without departing from the scope or spirit of the invention.

Thus, it can be seen that the invention accomplishes at least all of its objectives.

I claim:

1. A device for use in shooting a basketball into a basketball hoop, the hoop having a rim with depending net hangers, and a net descending from the net hangers, comprising:

an annular member having top and bottom edges; and means for detachably mounting the annular member to the rim the mounting means detachably mounted to the rim, with the top edge of the annular member positioned immediately below the rim and adjacent to and at least partially covering the net hangers so that the annular member provides a visual guide of the rim position when shooting the basketball into the basketball hoop.

2. The device of claim 1 wherein the annular member is made of rigid material.

3. The device of claim 1 wherein the annular member is made of plastic.

4. The device of claim 1 wherein the annular member is made of a resilient material.

5. The device of claim 1 wherein the annular member is flattened in cross section.

6. The device of claim 1 wherein the mounting means comprises a plurality of hooks extending upward from the annular member so that the hooks can detachably attach to the rim of the basketball hoop.

7. The device of claim 1 wherein the mounting means comprises a plurality of tabs having snaps, the tabs attached to the annular member, the tabs detachably attachable by the snaps to the basketball hoop rim.

8. A device for use in shooting a basketball into a basketball hoop, the hoop having a rim, the rim having a net holding means, and a net descending from the net holding means of the rim, comprising:

an annular member;

mounting means for detachably mounting the annular member to the rim, the mounting means comprising a series of holes through the annular member and a rope threaded through the holes, the rope attached to the net holding means so that the annular member extends below the rim and provides a visual guide when shooting the basketball into the basketball hoop.

9. A device for use in shooting a basketball into a basketball hoop, the hoop having a rim, the rim having a net holding means, and a net descending from the net holding means of the rim, comprising:

an annular member;

a mounting means comprising a plurality of loops attached to the annular member and a rope threaded through the loops, the rope attached to the net holding means so that the annular member extends below the rim and provides a visual guide when shooting the basketball into the basketball hoop.

10. A device for use in shooting a basketball into a basketball hoop, the hoop having a rim and a net descending from the rim, comprising:

an annular member;

the annular member having an interior surface and an exterior surface, the interior surface having a different color than the exterior surface;

mounting means for detachably mounting the annular member to the rim so that the annular member extends below the rim and provides a visual guide when shooting the basketball into the basketball hoop.

11. A device for use in shooting a basketball into a basketball hoop, the hoop having a rim and a net descending from the rim, comprising:

an annular member having a top and bottom, and a forward half and rearward half, the forward half shorter from top to bottom than the rearward half;

mounting means for detachably mounting the annular member to the rim so that the annular member extends below the rim and provides a visual guide when shooting the basketball into the basketball hoop.

12. The device of claim 11 wherein the annular member has an interior surface and an exterior surface, the interior surface having a different color than the exterior surface.

13. The device of claim 11 wherein the annular member has an interior and exterior surface, the interior surface having a different texture from the exterior surface.

14. A device for use in shooting a basketball into a basketball hoop, the hoop having a rim with depending net hangers and a net descending from the net hangers:

a member forming a partial circle having top and bottom edges; and means for detachably mounting the member to the rim the member detachably mounted to the rim and the top edge of the member positioned immediately below the rim and adjacent to and at least partially covering the net hangers so that the member provides a visual guide of the rim position when shooting the basketball into the basketball hoop while not interfering with the shooting of the basketball into the hoop.

15. A device for use in shooting a basketball into a basketball hoop, the hoop having a rim and a net descending from the rim, comprising:

an annular member, the annular member having an interior surface and an exterior surface, the interior surface having a different texture from the exterior surface;

mounting means for detachably mounting the annular member to the rim so that the annular member extends below the rim and provides a visual guide when shooting a basketball into the basketball hoop.

16. A device for use in shooting a basketball into a basketball hoop, the hoop having a rim and a net descending from the rim, comprising:

an annular member the annular member having an interior surface and exterior surface, the interior surface having a different color than the exterior surface;

means for detachably mounting the annular member to the rim having a net descending from the rim, the annular member extending immediately below the rim and no portion of the annular member extending above the rim so that the annular member provides a visual guide of the rim position when shooting the basketball into the basketball hoop.

17. A device for use in shooting a basketball into a basketball hoop, the hoop having a rim and a net descending from the rim, comprising:

an annular member the annular member having a top and a bottom, and a forward half and a rearward half, the forward half shorter from top to bottom than the rearward half;

means for detachably mounting the annular member to the rim having a net descending from the rim, the annular member extending immediately below the rim and no portion of the annular member extending above the rim so that the annular member provides a visual guide of the rim position when shooting the basketball into the basketball hoop.

18. The device of claim 17 wherein the annular member has an interior surface and exterior surface, the interior surface having a different color than the exterior service.

* * * * *